US005713733A

United States Patent [19]

Ming

[11] Patent Number: 5,713,733

[45] Date of Patent: Feb. 3, 1998

[54] CIGARETTE LIGHTER

[76] Inventor: Chen Cheng Ming, P.O. Box 82-144, Taipei, Taiwan

[21] Appl. No.: 703,359

[22] Filed: Aug. 26, 1996

[51] Int. Cl.[6] ..... F23A 14/28

[52] U.S. Cl. ..... 431/344; 222/3; 137/550

[58] Field of Search ..... 431/344; 222/3; 137/550

[56] References Cited

U.S. PATENT DOCUMENTS

| | | | |
|---|---|---|---|
| 2,662,590 | 12/1953 | Reich | 431/344 |
| 3,213,649 | 10/1965 | Sakamoto | 431/344 |
| 3,590,591 | 7/1971 | Genoud | 431/344 |
| 4,289,478 | 9/1981 | Nitta | 431/344 |
| 5,388,986 | 2/1995 | Khemarangsan | 431/344 |

*Primary Examiner*—Carl D. Price
*Attorney, Agent, or Firm*—A & J

[57] ABSTRACT

An improvement in the structure of a cigarette lighter including a gas container having an open top, a head member fitted in the top of the container and having an internally threaded cavity, a core 1 including a T-shaped member and a fixing seat, and a plug threadedly engaged with the cavity and located upon the core, the plug provided at a bottom with a passage engaged with the projection of the fixing seat, whereby the cigarette lighter is simplified in structure and assembly.

1 Claim, 5 Drawing Sheets

CIGARETTE LIGHTER

BACKGROUND OF THE INVENTION

1. Field of the Invention

This invention relates to an improved cigarette lighter and in particular to one which is simple in construction and easy to assemble.

2. Description of the Prior Art

With reference to to FIGS. 1 and 2, there is shown the structure of a prior art cigarette lighter. As illustrated, the prior art cigarette lighter mainly comprises a gas container A1, a head A2 with a hole A21, a tubular member A3, a foamed rubber tube A4, a seat A5, a foamed rubber pad A6, a packing ring A8, a plug A7 with a circular groove A71.

However, such a prior art cigarette lighter has the following drawbacks:

1. It is necessary to adjust the flame by manual power thereby increasing the manufacturing cost.
2. There are too many component parts.
3. The packing ring 8 is easily deformed thereby causing gas leakage.

Therefore, it is an object of the present invention to provide an improvement in the structure of a cigarette lighter.

SUMMARY OF THE INVENTION

This invention relates to an improvement in the structure of a cigarette lighter.

It is the primary object of the present invention to provide an improvement in the structure of a cigarette lighter which is easy to assemble.

It is another object of the present invention to provide an improvement in the structure of a cigarette lighter which is low in cost.

It is still another object of the present invention to provide an improvement in the structure of a cigarette lighter which can prevent the lighter from ejecting flame.

It is still another object of the present invention to provide an improvement in the structure of a cigarette lighter which can reduce the pressure of the released gas.

It is another object of the present invention to provide an improvement in the structure of a cigarette lighter which is practical in use.

The invention accordingly consists of features of constructions and method, combination of elements, arrangement of parts and steps of the method which will be exemplified in the constructions and method hereinafter disclosed, the scope of the application of which will be indicated in the claim following.

DETAILED DESCRIPTION OF THE PREFERRED EMBODIMENT

Figure 1:
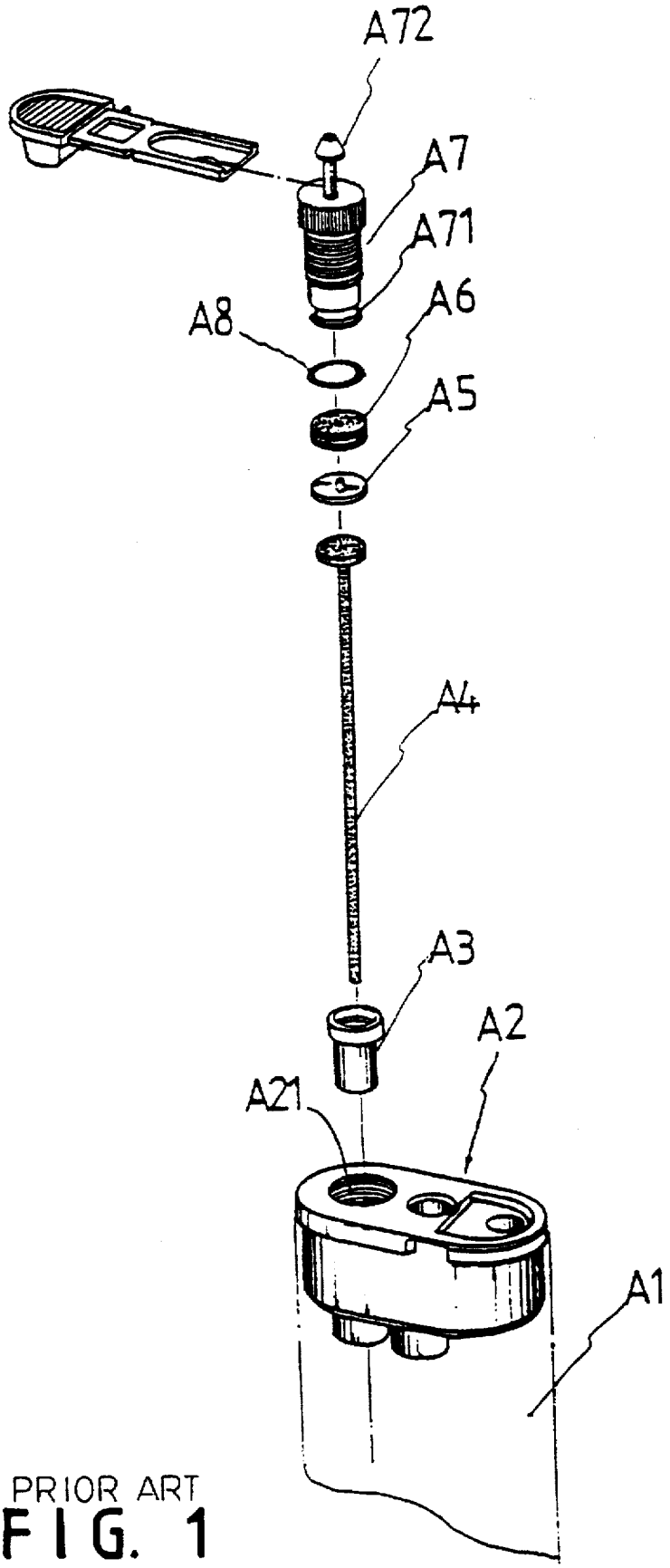
PRIOR ART FIG. 1
FIG. 1 is an exploded view of a prior art gas control structure for a lighter.
Figure 2:
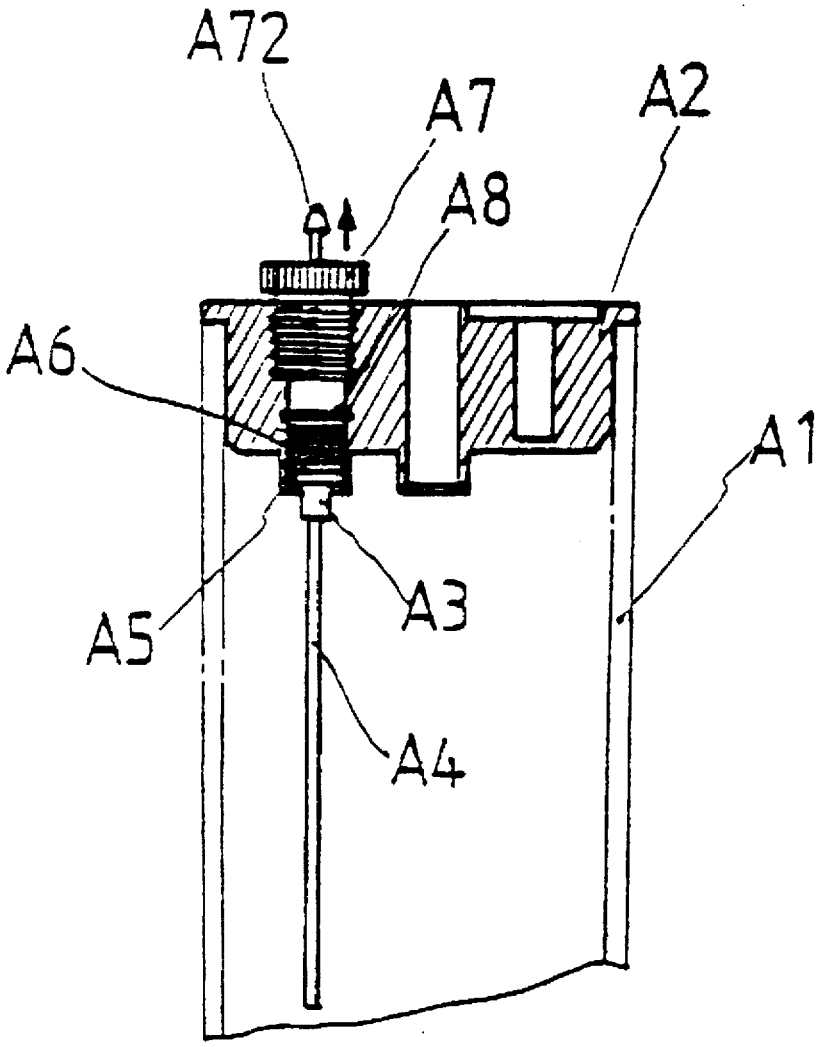
PRIOR ART FIG. 2
FIG. 2 is a sectional view of the prior art gas control structure for a lighter.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 3:
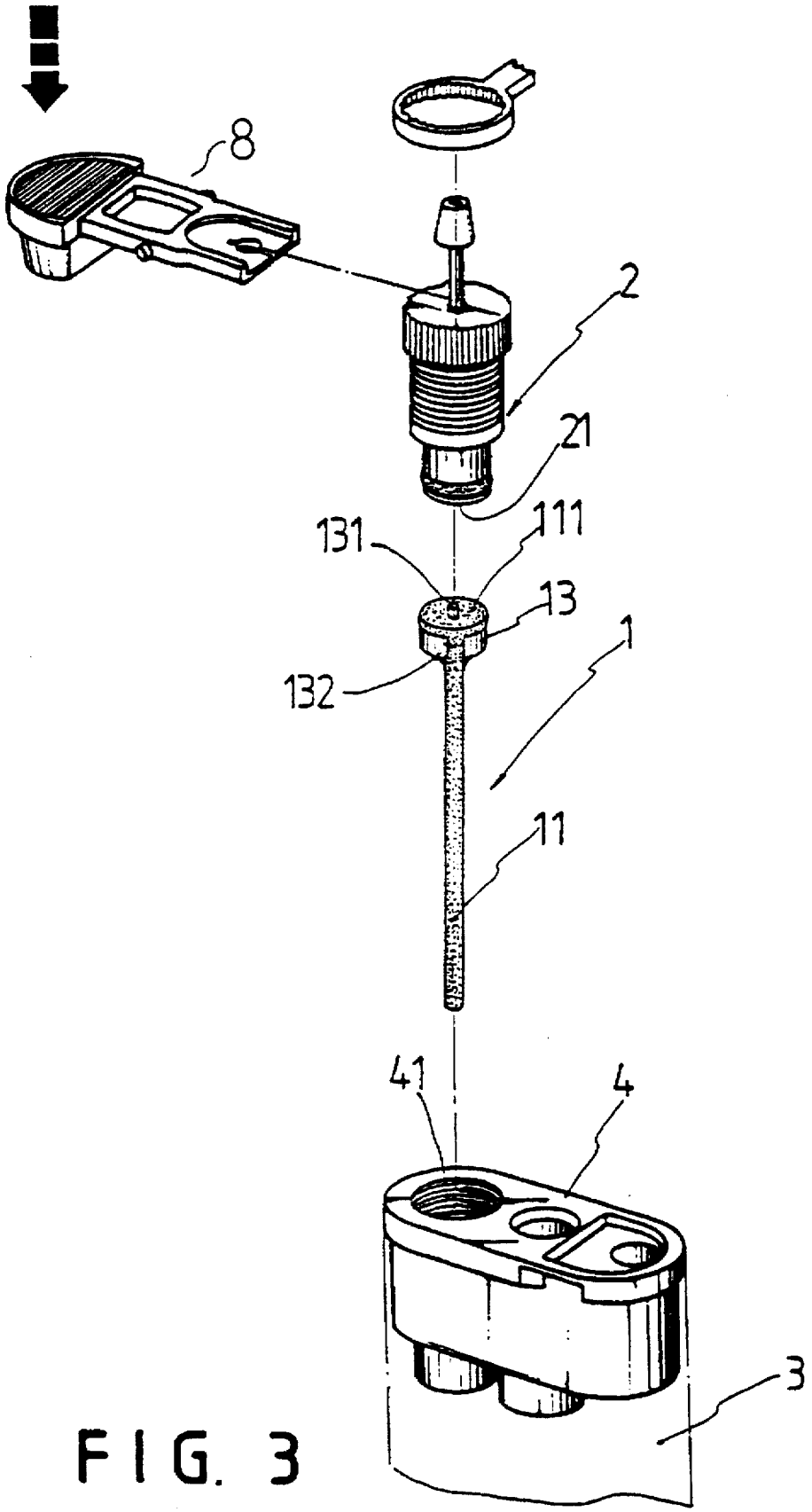
FIG. 3 is an exploded view of the present invention.

With reference to the drawings and in particular to FIG. 3 thereof, the cigarette lighter according to the present invention mainly comprises a container 3, a head member 4, a core 1, a plug 2 and a press plate 8.

The container 3 is used to fill liquefied gas and has an open top. The head member 4 is adapted to engage the top of the container 3 and has an internally threaded cavity 41. The core 1 is fitted into the cavity 41 of the head member 4. The plug 2 is engaged with the cavity 41 of the head member 4 and disposed on the core I thereby preventing the core 1 from dropping out of the head member 4. The press plate 8 is mounted on the plug 2.

Figure 4:
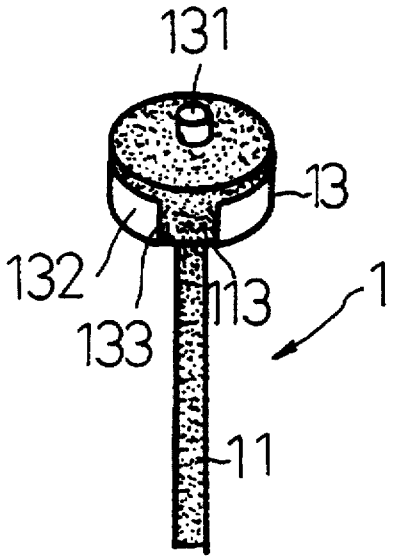
FIG. 4 is a perspective view of the core.
Figure 5:
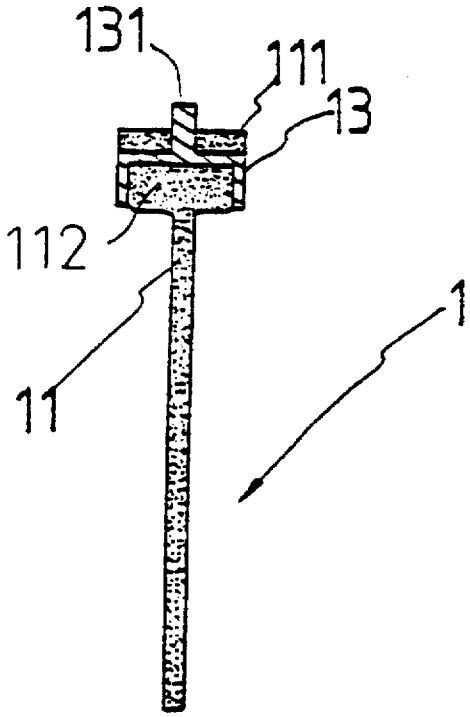
FIG. 5 is a sectional view of the core.
Figure 6:
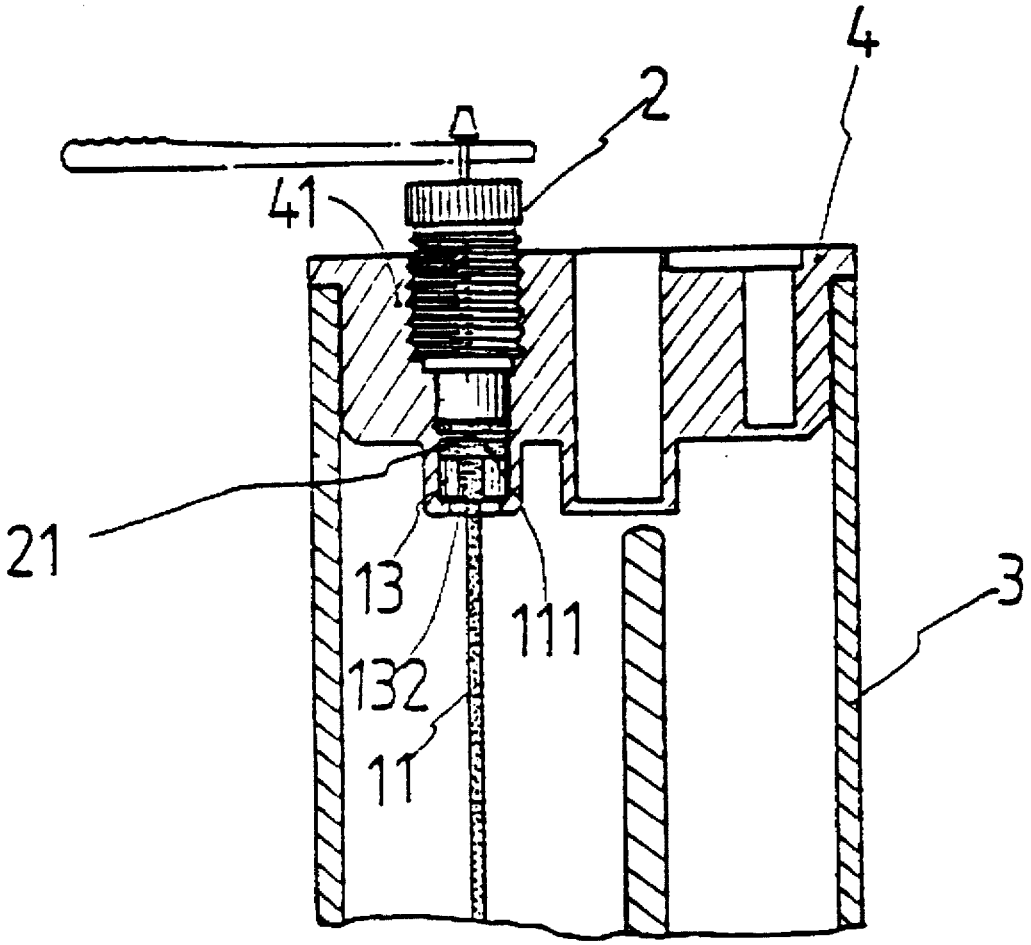
FIG. 6 is a sectional view of the present invention.

As shown in FIGS. 4, 5 and 6, the core 1 includes a T-shaped member 11 and a fixing seat 13. The T-shaped member 11 is an integral member made of powder fiber so that it can suck up the liquefied gas thereby enabling the last drop of the liquefied gas to be used. The upper end of the T-shaped member 11 is formed with an enlarged upper cylindrical portion 111 and an enlarged lower cylindrical portion 112 between which there are two opposite supports 113 thereby forming a space between the upper and lower cylindrical portions 111 and 112. Further, the upper and lower cylindrical portions 111 and 112 are of the same diameter.

The fixing seat 13 is formed at the lower end with a hollow cylindrical hood 132 and at the upper end with a projection 131. The hollow cylindrical hood 132 of the fixing seat 13 is formed with two opposite notches 133. The fixing seat 13 is fitted within the slot between the upper and lower cylindrical portions 111 and 112 so that the hollow cylindrical hood 132 of the fixing seat 13 encloses the lower cylindrical portion 111 of the T-shaped member 11, the projection 131 extends upwardly out of the center of the upper cylindrical portion 111 of the T-shaped member, and the notches 133 receive respective supports 113 of the T-shaped member 11.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An improvement in the structure of a cigarette lighter comprising:

a gas container having an open top;

a head member fitted in the top of said container and having an internally threaded cavity;

a core having a cross sectional T-shape and a fixing seat, said core being an integral member made of powder fiber, an upper end of said core being formed with an enlarged upper cylindrical portion and an enlarged lower cylindrical portion between which there are two opposite supports thereby forming a space between said upper and lower cylindrical portions, said upper and lower cylindrical portions being of same diameter, said fixing seat being formed at a lower end with a hollow cylindrical hood and at an upper end with a projection, said hollow cylindrical hood being formed with two opposite notches, said fixing seat being fitted within said slot with said hollow cylindrical hood enclosing said lower cylindrical portion of said core, said projection extending upwardly out of a center of said upper cylindrical portion of said core, and said notches receiving said supports; and a plug threadedly engaged with said cavity and located upon said core, said plug being provided at a bottom with a passage engaged with the projection of said fixing seat.

* * * * *